United States Patent [19]

Foerster et al.

[11] 4,244,129

[45] Jan. 13, 1981

[54] ADJUSTABLE CARD RACK

[75] Inventors: Gerhard A. Foerster, Woodbridge; Thaddeus J. Soboleski, North Haven, both of Conn.

[73] Assignee: Pyramid Plastics, Inc., Meriden, Conn.

[21] Appl. No.: 49,472

[22] Filed: Jun. 18, 1979

[51] Int. Cl.[3] ..... G09F 1/10; B42F 17/00

[52] U.S. Cl. ..... 40/373.2; 40/124.2; 211/55

[58] Field of Search ..... 40/124.2 X, 124, 124.4, 40/375, 373, 374, 156, 382, 383; 211/54.1, 55, 56, 128; 312/183, 193

[56] References Cited

U.S. PATENT DOCUMENTS

| | | | |
|---|---|---|---|
| 2,302,771 | 11/1942 | Hobby | 40/124 |
| 2,872,185 | 2/1959 | Kropp | 40/124.2 X |
| 2,981,019 | 4/1961 | Baird | 40/124 |
| 3,428,186 | 2/1969 | Michel | 211/55 |
| 3,465,460 | 9/1969 | Dahl, Jr. | 40/383 |
| 3,691,664 | 9/1972 | Stoian | 40/124.4 |
| 4,041,631 | 8/1977 | Stevens | 40/124.2 |
| 4,077,520 | 3/1978 | Stevenson | 211/55 |
| 4,081,080 | 3/1978 | Rorex | 40/124.2 X |

*Primary Examiner*—John F. Pitrelli
*Assistant Examiner*—G. Lee Skillington

[57] ABSTRACT

A card rack has dividers that extend from the front wall to the back wall at a acute angle. Each divider has a plurality of holes, and corresponding holes in all of the dividers are aligned to provide a plurality of elongated passages. A rod extends through one of the passages to determine the depth into the compartments between the dividers to which cards can be inserted. By withdrawing the rod from one passage and reinserting it into another passage, the depth of the compartment can be adjusted. This depth adjustment is provided in a card rack that is also adjustable in width.

8 Claims, 4 Drawing Figures

ADJUSTABLE CARD RACK

BACKGROUND OF THE INVENTION

The present invention is directed to racks for containing cards, and it is directed in particular to an arrangement for adjusting the depths of the compartments in the rack in which the cards are received.

The cards that are intended to be contained by card racks come in various sizes, and it is desirable that the card rack be sized to fit the card, both in card length and card width. It is convenient for one model of card rack to be adjustable to fit a wide range of card sizes, particularly from the point of view of the manufacturer, for whom plant and inventory costs are reduced if the number of separate models that he must produce is lowered. The adjustability is also somewhat desirable from the point of view of the user of the card rack because he need not dispose of his card rack if he begins using a different size card. Also, for companies that use a large number of card racks and different kinds of cards, there is some desirability from the standpoint of inventory costs in being required to keep only one model of card rack in stock.

In view of the desirability of the adjustable card racks, several have been suggested. One example is that shown in U.S. Pat. No. 2,981,019 to Baird, in which the depth of the card-rack compartments as well as their width can be adjusted. Width adjustability is provided by two halves, each containing one of the sidewalls, whose spacing can be adjusted by means of slots in overlapping back walls in the two halves. The depths of the compartments are adjusted by a rather complicated bracket arrangement in which the partitions of the compartments extend from a fixed position in the front face of the rack about which they can be pivoted toward a bracket adjustably mounted on the rear wall of the card rack. The partitions are received in the bracket, and as the bracket is raised and lowered, the amount of partition that is outside the bracket is varied. This varies the depth of the compartments.

A somewhat less complicated arrangement for varying compartment depth is illustrated in U.S. Pat. No. 3,691.664 to Stoian, in which front and back halves are provided whose front-to-back spacing is adjustable. Cooperating partition portions overlap and slide with respect to each other as the spacing between the front and back halves is varied. Although this arrangement is relatively simple, it will be shortly seen that is does leave some room for increased simplicity. Furthermore, the use of this arrangement for depth adjustment does not appear to be particularly well suited to the simultaneous provision of width adjustment.

It is accordingly an object of the present invention to provide depth adjustability in an exceedingly simple manner. It is a further object of the present invention to provide this in a card rack whose width can also be adjusted. It is still another object to afford these characteristics in a card rack that is easy to manufacture and use.

SUMMARY OF THE INVENTION

The foregoing and related objects are achieved in an improvement in a card rack assembly including a pair of elongated spaced-apart sidewalls. Each sidewall provides first and second longitudinally extending edges and the first edges and second edges lie generally in first and second substantially parallel common planes respectively. The card-rack assembly further includes means supporting the sidewalls in opposed, spaced relationship and a multiplicity of substantially parallel divider portions supported between the sidewalls at an acute angle to the common planes to form card compartments between adjacent divider portions. The compartments are open toward the first common plane, and the card-rack assembly is thereby permitted to be mounted with the common planes extending vertically and the divider portions inclined downwardly from the first common plane toward the second common plane to permit cards to be received in the card compartments at the first common plane. In the improved assembly, a plurality of adjacent ones of the divider portions has at least one aperture through it aligned with the apertures in the other divider portions of the plurality of adjacent divider portions. This provides an elongated passage through the divider portions and the compartments between them. The improved assembly also includes a stop member removably supported in it and extending through the aligned apertures to limit the depth of the compartments to which cards can be inserted.

The card-rack assembly ordinarily includes a back wall mounted approximately in the second common plane and extending through the positions of the compartments to limit compartment depth when the stop member is removed. Compartment depth is thereby adjustable by removal of the stop member.

In the preferred embodiment, the stop member includes a rod extending through the elongated passage that extends through the divider portions and the compartments. It also includes a cap on the end of the rod that is the top end when the card-rack assembly is mounted with the common plane extending vertically and the divider portions inclined downwardly from the first common plane toward the second common plane. The cap is sized to prevent it from passing through the apertures, and it can thereby support the stop rod.

Preferably, each of the portions includes a plurality of apertures through it aligned with corresponding apertures in the other divider portions to provide a plurality of passages. The apertures in the divider portions are spaced at different distances from the first common plane. Adjustment of compartment depth is thereby permitted by removal of the stop member from one of the passages and its insertion into another passage.

In the preferred embodiment, the card-rack assembly includes first and second halves. The first half includes the first sidewall and the divider portions, which extend from the first sidewall. The first half further includes first front and back walls extending inwardly from the first sidewall at its first and second edges, respectively, and lying approximately in the first and second common planes, respectively. The front wall has openings in it aligned with the compartments to permit cards to be inserted through the front wall into the compartments. The second half of the card-rack assembly includes the second sidewall and second front and back walls extending inwardly from the second sidewall at its first and second edges, respectively, and lying approximately in the first and second common planes, respectively. The second front wall has openings therein aligned with the compartments to permit cards to be inserted through the second front wall into the compartments. The first and second back walls are offset to permit them to overlap, and each back wall has at least two vertically spaced apertures through it each aligned with its corresponding aperture in the other back wall in the direction substantially perpendicular to the sidewalls and overlapping its corresponding aperture to permit a fastener to be inserted through them. The card-rack assembly further includes fasteners extending through pairs of corresponding apertures in the back walls, the fasteners are tightenable to maintain the spacing of the sidewalls. At least one of each pair of corresponding apertures is elongated in the direction perpendicular to the sidewalls to permit the spacing of the sidewalls to be changed when the fasteners are loosened.

BRIEF DESCRIPTION OF THE DRAWINGS

These and further features and advantages of the present invention are described with reference to the accompanying drawings, in which.

DETAILED DESCRIPTION OF THE PREFERRED EMBODIMENT

Figure 1:
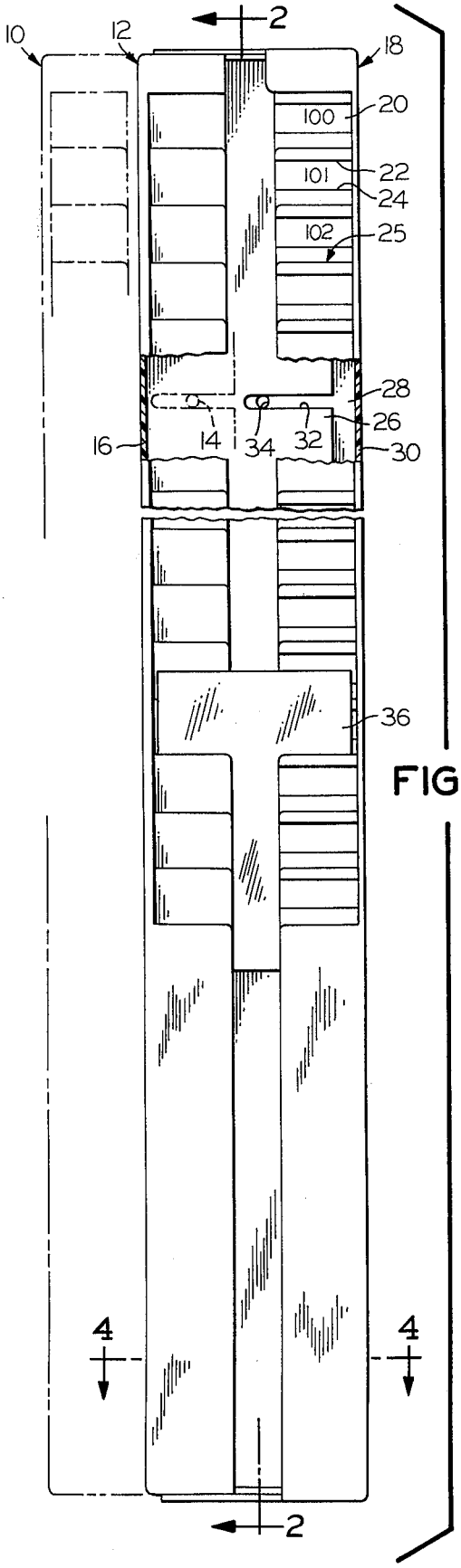
FIG. 1 is a vertical elevation, partly broken away, of a card rack that illustrates the teachings of the present invention.
Figure 2:
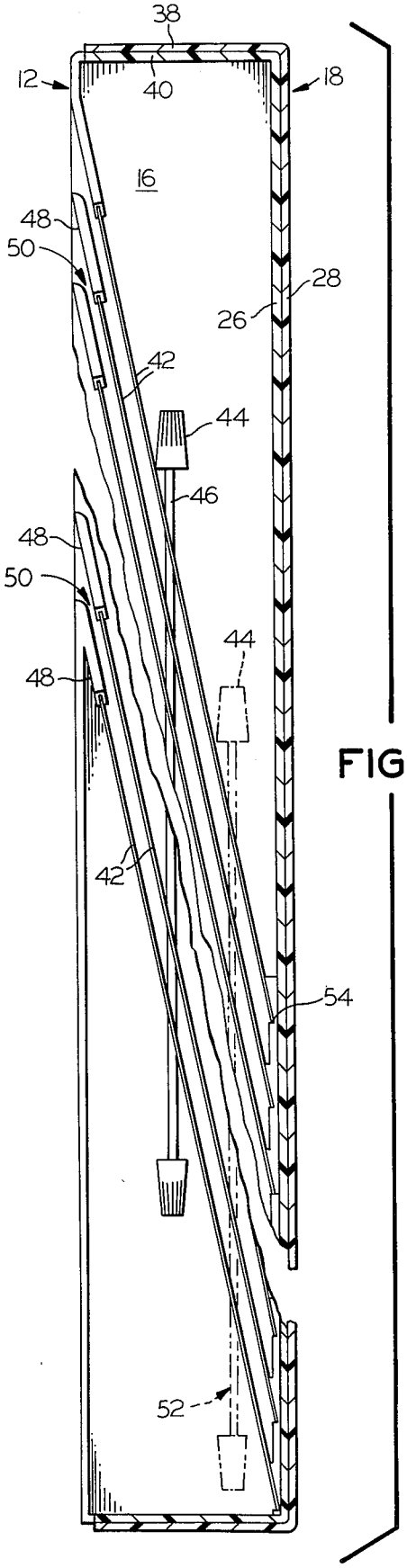
FIG. 2 is a sectional view taken at line 2—2 of FIG. 1.

The drawings show a card rack in which left and right halves 12 and 18 are adjustable in spacing as suggested by phantom 10 of FIG. 1. This permits adjustment for card width. Adjustment for card depth is illustrated in FIG. 2, in which there are shown two positions of a stop rod 46 that passes through corresponding holes in each of a multiplicity of divider portions 42. The stop-rod position shown in phantom and designed by reference numeral 52 results in a deeper compartment depth then does the stop-rod position shown in solid.

Figure 4:
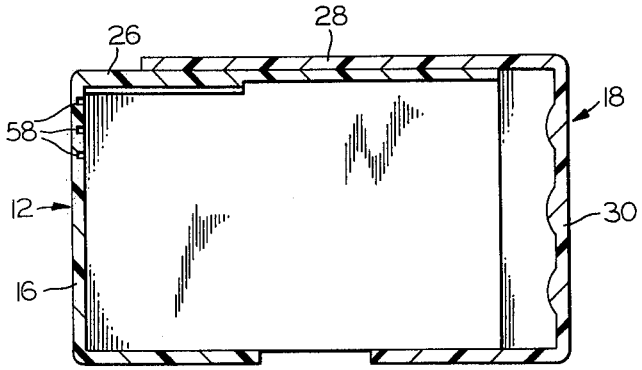
FIG. 4 is a sectional view taken at line 4—4 of FIG. 1.

Card-rack halves 12 and 18 have sidewalls 16 and 30, respectively; and rear walls 26 and 28, respectively. When the rack is mounted in its normal position, the longitudinal edges of sidewalls 16 and 30 are in a generally vertical orientation. The front edges of both sidewalls lie generally in a common plane, and the back edges of the sidewalls also lie approximately in a common plane, although as FIG. 4 shows, left rear wall 26 is offset slightly from right rear wall 28 so that they can overlap. Top and bottom walls extending perpendicularly to the back and side walls also overlap, as is exemplified in FIG. 2 by top and bottom walls 38 and 40 of card-rack halves 18 and 12 respectively. FIG. 4 also shows that the left and right halves can be adjusted to vary the spacing between side-walls 16 and 30. The left half 12 is received in the right half 18, and the spacing between walls 16 and 30 is reduced as left half 12 is inserted farther into right half 18.

As FIG. 1 shows, a slot 32 is provided in left rear wall 26 and a hole 34 is provided in right rear wall 28. Slot 32 and hole 34 are aligned in the direction perpendicular to sidewalls 16 and 30 so that a screw (omitted from FIG. 1 for the sake of convenience) can fit through both the slot and the hole simultaneously. It is apparent that this allows a variety of spacing, but when a screw or other appropriate fastener is tightened, the spacing is held constant. Another slot and hole are also provided lower on the rear walls but are not shown in the drawings.

The left half of the card rack shown in FIG. 1 is seen in FIG. 2, which is a section taken at line 2—2 of FIG. 1. There it is seen that the front wall of left half 12 is interrupted periodically along part of its length to provide slots 50 into which cards may be inserted into the card rack. The slots 50 leave fin-like portions projecting from sidewall 16 that make up the front wall along that part of its length into which cards are to be inserted. Rear wall 26 of the left half is provided with a multiplicity of vertically spaced platform portions 54 that support divider portions 42, which extend from the platform portions 54 to the fins 48.

The left half 12 can conveniently be constructed by molding as a unitary part the upper, lower, rear, side, and front walls including the fin portions 48, preferably out of polystyrene plastic. The dividers 42 (best seen in FIG. 3) are manufactured separately and then glued into place on fins 48 and platforms 54. As is suggested in FIG. 4, a multiplicity of narrow, shallow slots 58 extends diagonally along sidewall 16, and divider portions 42 are received in slots 58. Divider portions 42 are not shown in FIG. 4 so that slots 58 may be seen more easily.

Figure 3:
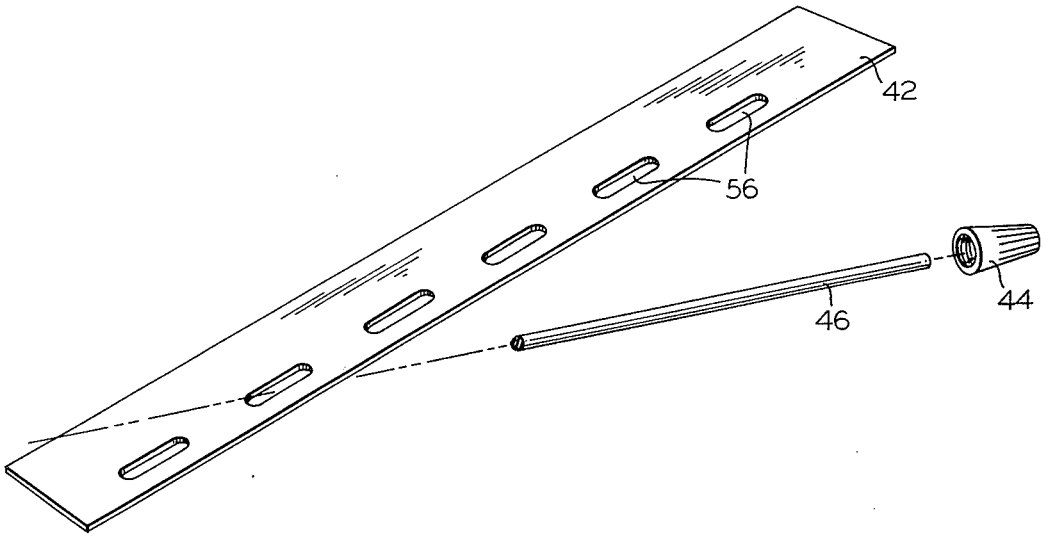
FIG. 3 illustrates one of the divider portions used in the card rack of FIGS. 1 and 2 and shows the manner in which it is penetrated by the stop rod.

As can be appreciated by reference to FIGS. 2 and 3, slots 56 in divider portions 42 are vertically aligned so that a stop member in the form of a plastic rod 46 with a plastic caps 44 threaded onto either end may pass through corresponding holes in the dividers and through the compartments defined between the dividers. It can be appreciated by reference to FIG. 2 that, when a card is inserted through slot 50 into the compartment between two dividers, it can only be inserted until its bottom reaches stop rod 46. Thus, the stop member determines the effective depth of the compartment. If a greater compartment depth were desired, rod 46 could be removed from the position shown in solid in FIG. 2 by removing the lower end cap and withdrawing rod 46. The stop member would then be reinserted at the position shown in phantom and designated by reference numeral 52, and the card would then be allowed to be inserted farther. For maximum compartment depth, the stop member could be withdrawn and kept out, and then the compartment depth would be determined by the rear wall. Thus, if each divider portion has six slots, the number of compartment depths that could be provided would be seven.

It should be noted at this point that the apertures in divider 42 are in the form of elongated slots because of the angle between the divider and stop rod 46, not because it is intended that there be a variation in the compartment depth provided by each slot. Of course, it would be possible to provide the adjustability in that fashion—i.e., by extending the lengths of the slots and varying depth by moving the rod along the elongated slot. This would provide infinite adjustability, but it is thought that the discrete arrangement shown in the drawings provides ample adjustability and affords the simplicity intended by the present invention most effectively. Nonetheless, the teachings of the present invention could be employed with slots that permit a variety of rod positions in the same slot.

More of the details of the preferred embodiment are illustrated in FIG. 1, which shows that the right half of the card rack also has a series of slots 25 that are aligned with corresponding slots 50 in the left half so that a card being inserted in one of the compartments can pass through both of the front walls simultaneously. A card so positioned is indicated by reference numeral 36. In the preferred embodiment, the right half does not contain the divider portions that the left half contains. Also unlike the left half, the right half has opposing undercut section 22 and 24 between slots 25 in the front walls of the right half that can conveniently contain identifying labels such as the one, indicated by reference numeral 20, that bears the legend 100.

FIG. 1 also shows that the back wall of the right portion can contain a second hole such as 14 aligned with slot 32 in the direction perpendicular to sidewalls 16 and 30. Such a hole would be provided for the situation suggested by phantom 10, in which hole 34 could not be used for fastening the two halves together. Of course, only one such hole would be necessary if slot 32 were made sufficiently wide, but it may be desirable from the strength standpoint to limit the length cf slot 32.

It will be appreciated from the foregoing description that many of the details of the preferred embodiment could be altered or eliminated without losing most of the benefits of the present invention. In particular, it is thought that many users of the preferred embodiment of the invention will dispense with the end caps 44. Both divider portions 42 and stop rod 46 are made of somewhat flexible plastic, and there is in many cases some resilient bending as the stop rod 46 is threaded through the dividers 42. As the result, enough friction usually exists between rod 46 and the sides of slots 56 to provide rod 46 with all the support it needs. However, end caps 44 can be supplied if a positive stop is desired.

It is apparent that the arrangement described above affords a high degree of simplicity. It allows the depths of the compartments to be changed very easily, and it lends itself to inexpensive production. Furthermore, this simple method of depth adjustment can be provided in an arrangement that also provides for simple width adjustment. Accordingly, direct manufacturing costs, plant costs, and inventory costs can all be reduced through the use of the present invention.

Having thus described the invention, we claim:

1. In a card-rack assembly including a pair of elongated spaced-apart sidewalls, each of which provides first and second longitudinally extending edges, said first edges and second edges lying generally in first and second substantially parallel common planes, respectively, said card-rack assembly further including means supporting said sidewalls in opposed, spaced relationship and a multiplicity of divider substantially parallel to each other and portions supported between said sidewalls at an acute angle to said common planes to form card compartments between adjacent divider portions, said compartments being open toward said first common plane, said card-rack assembly thereby being permitted to be mounted with said common planes extending vertically and said divider portions inclined downwardly from said first common plane toward said second common plane to permit cards to be received in said card compartments at said first common plane, the improvement wherein each of a plurality of adjacent ones of said divider portions has at least one aperture therethrough aligned with said apertures in the other divider portions of said plurality of adjacent divider portions to provide elongated passage therethrough and through said compartments formed thereby, and wherein there is included a stop member removably supported in said assembly and extending through said aligned apertures to limit the depth of said compartments to which cards can be inserted.

2. The card-rack assembly of claim 1 further including a back wall mounted approximately in said second common plane and extending through the positions of the compartments to limit compartment depth when said stop member is removed, compartment depth thereby being adjustable by removal of said stop member.

3. The card-rack assembly of claim 2 in which said stop member includes a rod extending through said elongated passage through said divider portions and said compartments.

4. The card-rack assembly of claim 3 wherein said stop member further includes a cap on the end of said rod that is the top end when said card-rack assembly is mounted with said common plane extending vertically and said divider portions inclined downwardly from said first common plane toward said second common plane, said cap being sized to prevent it from passing through said apertures and thereby to support said stop rod.

5. The card-rack assembly of claim 1 where each of said divider portions includes a plurality of apertures therethrough aligned with corresponding apertures in the other divider portions to provide a plurality of passages, said apertures in said divider portions being spaced at different distances from said first common plane, adjustment of compartment depth thereby being permitted by removal of said stop member from one of said passages and insertion thereof into another of said passages.

6. The card-rack assembly of claim 5 in which said stop member includes a rod extending through said elongated passage through said divider portions and said compartments.

7. The card-rack assembly of claim 6 wherein said stop member further includes a cap on the end of said rod that is the top end when said card-rack assembly is mounted with said common plane extending vertically and said divider portions inclined downwardly from said first common plane toward said second common plane, said cap being sized to prevent it from passing through said apertures and thereby to support said stop rod.

8. The card-rack assembly of claim 4 or 7 wherein said card-rack assembly includes first and second halves thereof, said first half including said first sidewall and said divider portions, said divider portions extending from said first sidewall, and first half further including first front and back walls extending inwardly from said first sidewall at said first and second edges thereof, respectively, and lying approximately in said first and second common planes, respectively, said front wall having openings therein aligned with said compartments to permit cards to be inserted through said front wall into said compartments, said second half of said card-rack assembly including said second sidewall and further including second front and back walls extending inwardly from said second sidewall at said first and second edges thereof, respectively, and lying approximately in said first and second common planes, respectively, said second front wall having openings therein aligned with said compartments to permit cards to be inserted through said second front wall into said compartments, said first and second back walls being offset to permit them to overlap, each back wall having at least two vertically spaced apertures therethrough, each aligned with its corresponding aperture in the other back wall in the direction substantially perpendicular to said sidewalls and overlapping its corresponding aperture to permit a fastener to be inserted therethrough, said card-rack assembly further including fasteners extending through pairs of corresponding apertures in said back walls, said fasteners being tightenable to maintain the spacing of said sidewalls, at least one of each pair of corresponding apertures being elongated in the direction perpendicular to said sidewalls to permit the spacing of said sidewalls to be changed when said fasteners are loosened.

* * * * *